US006056344A

United States Patent [19]

Forsyth

[11] Patent Number: 6,056,344

[45] Date of Patent: May 2, 2000

[54] HANDLE

[76] Inventor: Ross Elliott Forsyth, 16 Desmond Avenue, Highett, Victoria 3190, Australia

[21] Appl. No.: 09/040,878

[22] Filed: Mar. 18, 1998

[51] Int. Cl.[7] ..... A45C 13/26; B65D 33/06

[52] U.S. Cl. ..... 294/171; 294/137

[58] Field of Search ..... 294/137, 165, 294/171; 383/6, 13, 25, 29; 16/114 R, 114 B

[56] References Cited

U.S. PATENT DOCUMENTS

| | | | |
|---|---|---|---|
| 2,215,116 | 9/1940 | Crary | 294/171 |
| 5,356,190 | 10/1994 | Torres | 294/171 |
| 5,651,575 | 7/1997 | Bystrom et al. | 294/171 |
| 5,658,029 | 8/1997 | Franko | 294/171 |
| 5,722,117 | 3/1998 | Nielsen | 294/171 |

FOREIGN PATENT DOCUMENTS

| | | | |
|---|---|---|---|
| 3509-679 | 9/1986 | Germany | 294/171 |
| 2135179 | 8/1984 | United Kingdom | 294/171 |
| 2153213 | 8/1985 | United Kingdom | 294/171 |
| 2228860 | 9/1990 | United Kingdom | 294/171 |

*Primary Examiner*—Dean J. Kramer
*Attorney, Agent, or Firm*—Ladas & Parry

[57] ABSTRACT

A disposable handle is provided for use with shopping bags. It is in the form of a tube having an access slot in its wall so that the surrounds of the finger openings of a bag can be passed through the access slot to extend along and within the tube.

3 Claims, 3 Drawing Sheets

HANDLE

This invention relates to a new and improved handle for shopping bags and the like.

Disposable plastic bags are in common use for carrying shopping and other materials. These bags include openings generally formed in each side of the bag and through which the fingers of a person can extend to allow the bag to be gripped near its top. The surrounds of the openings can in some circumstances be strengthened or reinforced although often, in order to reduce costs, this is not done.

These plastic bags are sometimes difficult to carry, particularly, when the contents are heavy. The plastic edges of the openings form considerable pressure points across the fingers of the hand.

An object of the present invention is to provide a suitable handle for such bags.

Handle arrangements have been proposed and used which comprise a hook member that extends through the bag openings and supported by a handle. Such arrangements are relatively expensive and shoppers must remember to carry with them or face the need to purchase a replacement.

A further object of the present invention is to provide a handle for such bags which is inexpensive and disposable.

In accordance with the present invention, there is provided a handle for bags which consists of a tube of cardboard or plastic of inexpensive construction. The tube of the present invention includes a continuous substantially longitudinal access slot in its wall and has a pair of open ends. In accordance with the present invention, the upper surrounds of the finger openings of a bag can be passed through the access slot so as to extend along and within the tube which then provides a handle for the bag.

The tube may be of any suitable length. It has been found that a tube length of about 70 to 80 mm is satisfactory.

The tube may be of any suitable cross sectional shape. For convenience, a tube of substantially circular cross section of about 30 mm in diameter has been found satisfactory. A diameter of between 20 and 40 mm is preferred.

The width of the access slot is preferably between 1 and 5 mm although it will be appreciated that when the tube is constructed of some materials, the size of the access slot can be increased or decreased by finger pressure, preferably to return resiliently to a substantially closed position trapped around the opening surrounds.

Preferably the access slot adjacent one or both of the tube ends progressively widens to an opening of about 50 to 90% of the diameter of the tube thus to assist in locating the handle surround within the tube as will be appreciated by those skilled in the art.

The handle tube may be made of any suitable material such as plastic or cardboard. A cardboard construction comprised by a continuously wound cardboard strip material has been found particularly satisfactory. A material of a thickness in the order of 1 to 2 mm provides a suitable handle.

The axis of the tube may be shaped, such as in the form of an arc, to provide a comfortable handle arrangement although to ensure that the handle remains inexpensive it is preferred that the tube be formed on a substantially straight axis. Similarly the walls of the tube may be moulded to provide finger receiving grooves along its under surface but again it is preferred that a substantially cylindrical wall is provided to ensure inexpensive manufacture.

The tube making up the handle of the present invention may be sufficiently resilient so that the width of the access slot as a bag is lifted or indeed the slot may be closed. In this event the edges of the access slot may overlap and a pressure sensitive adhesive used to affix the edges together. Alternatively, fastening means may be provided. These may be provided by one edge being formed into the shape of a hook or U-shape in cross-section and the opposite edge of the slot formed into a complementary shape so that the two can be joined together as will be appreciated by those skilled in the field.

The tubes may be so shaped and constructed that they can be fitted end to end in telescopic manner for easy transportation and storage.

The invention also includes a blank from which the disposable handle of the present invention can be formed. Thus, the disposable handles can be supplied to supermarkets or other venues in the form of flat sheets which can then be formed in situ into the handle shape.

The invention will now be further described with reference to the drawings which should not be taken as limiting the present invention.

FIG. 1 shows a disposable handle constructed in accordance with the present invention and a bag fitted thereto.

FIGS. 2 and 2*a* each show an alternative handle with an access slot of modified configuration.

Figure 1:
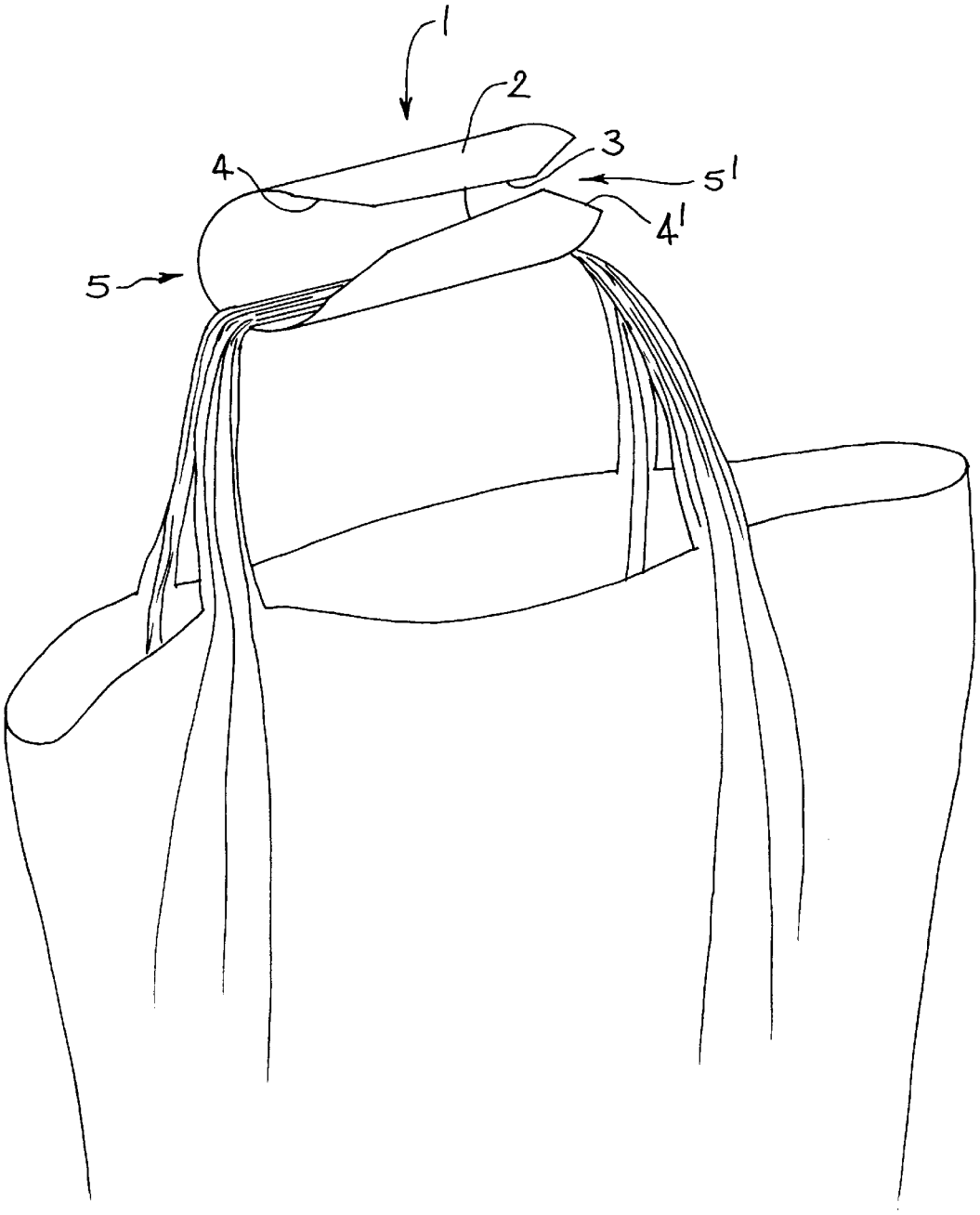

Referring to FIG. 1 there is shown a handle 1 which includes a substantially cylindrical wall 2. Slot 3 extends substantially longitudinally of the handle and opens at 4 and 4' towards the tube ends 5 and 5'. It will be seen that the surrounds of the finger openings of a bag can be placed through the slot 3 to be located within the tube 1 and that this is assisted by the extended openings at 4 and 4'.

The tube 1 can be made of sufficiently resilient material that the slot 3 can be substantially closed by finger pressure and/or when the bag is lifted.

Figure 2:
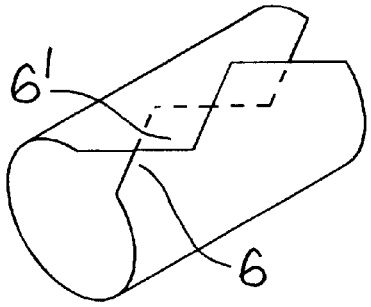
Figure 2A:
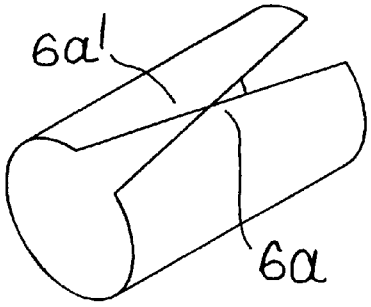

In FIGS. 2 and 2*a* the edges of the slot shown at 6 and 6' and 6*a* and 6*a'* respectively are shaped to provide an access slot of alternative configuration.

Figure 3:
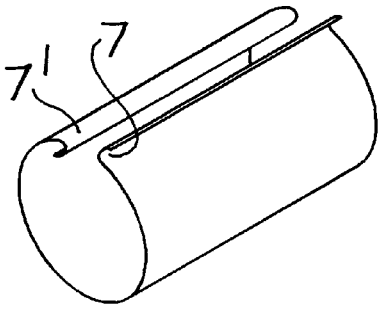
FIG. 3 shows an alternative arrangement where the edges of the access slot can be joined.

The tube shown in FIG. 3 includes at the edges shown at 7 and 7' complementary U-shaped recesses such that when the tube is squeezed the portions 7 and 7' can interlock to close the access slot and retain it in a closed position as will be appreciated by those skilled in the art.

Figure 4:
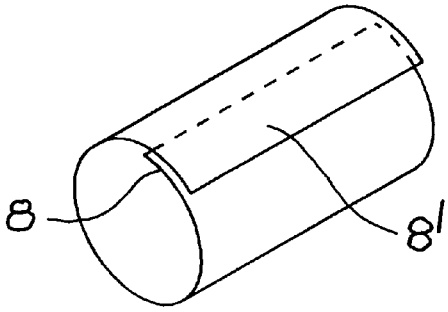
FIG. 4 shows a further embodiment where the edges of the access slot overlap.

The tube shown in FIG. 4 is constructed such that the edges 8 and 8' can overlap. One of these may be provided with a self-adhesive such that the tube can be fastened in its closed position as shown.

Figure 5:
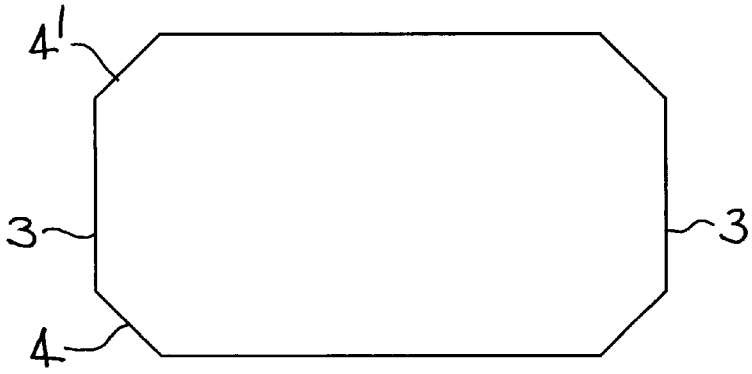
FIG. 5 shows a blank from which a disposable handle of FIG. 1 can be formed.
Figure 6:
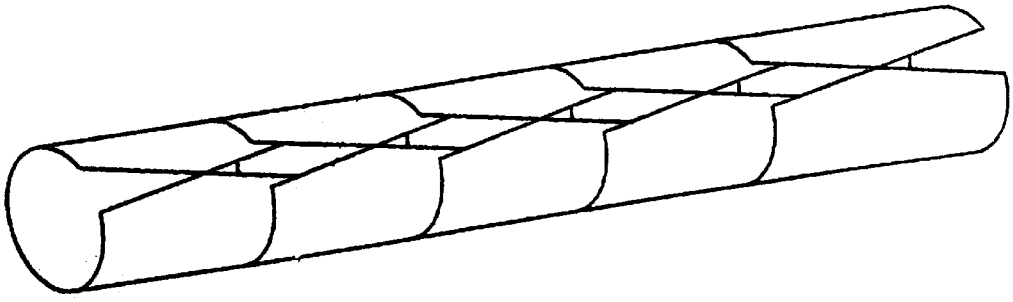
FIGS. 6 and 7 show an end to end telescopic arrangement of a plurality of the handle of FIG. 2*a*.
Figure 7:
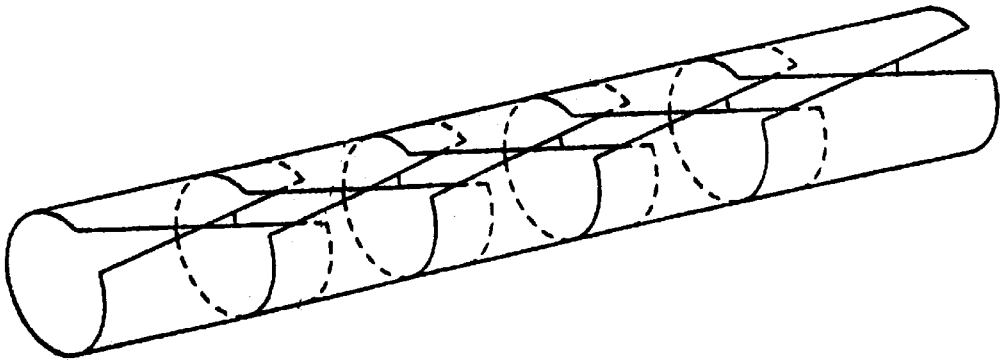

The blank shown in FIG. 5 can be closed to form the tube shown in FIG. 1 as will be appreciated by those skilled in the art.

A particular advantage of the present invention is that when the handle is released, it will generally remain affixed to the bag. The handle surrounds will not in themselves return through the slot 3. This means that the bag can be put down and picked up again without having to refit the handle. Additionally when the cardboard is to some extent resilient lifting of the handle will tend to close the slot 3 such that when the bag is put down the handle surrounds will not be able to return through the slot 3. However to remove the handle from the bag, the slot can be opened by the fingers and the handle surrounds removed.

The surfaces of the handles may be printed or otherwise carry advertising or promotional material as desired.

It will be appreciated that the handles can be made in standard tube manufacturing processes and then cut into the desired length. A plurality of handles can be assembled together by telescopically placing the end 5 of one tube into the tube opening 5' of an adjacent tube. In this way a large number of handles can be stored and carried in a convenient manner.

It will be appreciated that in accordance with the present invention there is provided an Inexpensive reusable or disposable handle for shopping bags and the like which is both simple to manufacture and easy to use. It will be appreciated that many variations may be made to the above described construction and arrangement of parts without departing from the spirit of the present invention.

I claim:

1. A disposable handle for plastic bags having finger openings, said handle comprising a hollow tube of resilient cardboard having a continuous wall and a pair of open ends and a substantially longitudinal access slot provided by wedge shaped cuts disposed along said longitudinal access slot to provide a pair of opposed tube edges which are separated at each open end and which taper together to overlap about midway along the length of the longitudinal access slot, each of said pair of opposed tube edges having sides which converge at an acute angle to form an apex with an apex of a first of said pair of opposed tube edges overlapping an apex of a second of said pair of opposed tube edges, the handle having a shape and a construction which permits the surrounds of a plastic bag finger opening to be fed into either end of the access slot to move the edges apart, whereafter said edges return to said overlapping position to retain the handle on the bag.

2. A disposable handle as claimed in claim 1, wherein said access slot progressively widens to a width at each open end of at least about 50% of the diameter of the tube.

3. A plurality of disposable handles for plastic bags having finger openings, each of said handles comprising a hollow tube of resilient cardboard having a continuous wall and a pair of open ends and a substantially longitudinal access slot provided by wedge shaped cuts disposed along said longitudinal access slot to provide a pair of opposed tube edges which are separated at each open end and which taper together to overlap about midway along the length of the longitudinal access slot, each of said pair of opposed tube edges having sides which converge at an acute angle to form an apex with an apex of a first of said pair of opposed tube edges overlapping an apex of a second of said pair of opposed tube edges, the handle having a shape and a construction which permits the surrounds of a plastic bag finger opening to be fed into either end of the access slot to move the edges apart, whereafter said edges return to said overlapping position to retain the handle on the bag and wherein said plurality of handles is arranged telescopically with the end of each tube fitted within or about the end of an adjacent tube.

* * * * *